US012146408B2

(12) United States Patent
Finkenzeller et al.

(10) Patent No.: US 12,146,408 B2
(45) Date of Patent: Nov. 19, 2024

(54) UNDERWATER DRILLING APPARATUS AND METHOD FOR CREATING A CASED BOREHOLE UNDERWATER

(71) Applicant: BAUER Maschinen GmbH, Schrobenhausen (DE)

(72) Inventors: Stefan Finkenzeller, Reichertshofen (DE); Jürgen Klippenstein, Augsburg (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 18/471,972

(22) Filed: Sep. 21, 2023

(65) Prior Publication Data

US 2024/0117681 A1 Apr. 11, 2024

(30) Foreign Application Priority Data

Oct. 6, 2022 (EP) ..... 22200104

(51) Int. Cl.
*E21B 7/124* (2006.01)

(52) U.S. Cl.
CPC ..... *E21B 7/124* (2013.01)

(58) Field of Classification Search
CPC . E21B 7/124; E21B 7/12; E21B 7/208; E21B 41/08; E02D 15/08; E02D 27/525; E02D 7/28
See application file for complete search history.

(56) References Cited

U.S. PATENT DOCUMENTS 8,757,289 B2 * 6/2014 Bauer ..... E02D 13/04 175/10

FOREIGN PATENT DOCUMENTS

| | | | |
|---|---|---|---|
| EP | 2 322 724 | A1 | 5/2011 |
| EP | 2 527 539 | A1 | 11/2012 |
| EP | 2 562 348 | A1 | 2/2013 |
| EP | 2 930 275 | B1 | 12/2017 |

(Continued)

OTHER PUBLICATIONS

The extended European search report issued by the European Patent Office on Feb. 3, 2023, which corresponds to European Patent Application No. EP 22200104.2-1002.

(Continued)

*Primary Examiner* — James G Sayre
(74) *Attorney, Agent, or Firm* — Studebaker & Brackett PC

(57) ABSTRACT

The invention relates to an underwater drilling apparatus comprising a lowerable platform configured for setting down on a waterbody bottom, at least one support tube axially displaceable and rotatably mounted on the platform, at least one tubular drive arranged on the platform and configured for rotationally driving the support tube, in order to rotationally introduce the support tube into the waterbody bottom, and an in-hole drilling rig arranged in the support tube, wherein the in-hole drilling rig comprises: a rig base body, at least one clamping device for bracing and securing the in-hole drilling rig in the support tube, and a drill head which is axially displaceably and is rotatably mounted on the rig base body and can be rotationally driven by means of a drill drive. According to the invention, it is provided that, when the support tube is rotationally driven, the in-hole drilling rig is arranged in the support tube and is axially clamped thereto.

12 Claims, 5 Drawing Sheets

(56) References Cited

FOREIGN PATENT DOCUMENTS

| | | | | | |
|---|---|---|---|---|---|
| EP | 3 333 324 | A1 | | 6/2018 | |
| EP | 2 615 239 | B1 | | 10/2019 | |
| JP | H097-1945 | A | * | 3/1997 | ..... E21B 7/12 |
| JP | 2004225346 | A | * | 8/2004 | ..... E21B 7/124 |
| JP | 2006-219911 | A | | 8/2006 | |
| WO | WO-2015131984 | A1 | * | 9/2015 | ..... E02D 17/16 |

OTHER PUBLICATIONS

An Office Action; mailed by the Japanese Patent Office on Apr. 16, 2024, which corresponds to Japanese Patent Application No. 2023-164920 and is related to U.S. Appl. No. 18/471,972; with English language translation.

* cited by examiner

UNDERWATER DRILLING APPARATUS AND METHOD FOR CREATING A CASED BOREHOLE UNDERWATER

TECHNICAL FIELD

The invention relates to an underwater drilling apparatus for creating a cased borehole underwater with a lowerable platform, according to claim 1.

The invention further relates to a method for creating a cased borehole under water with such an underwater drilling apparatus, according to claim 12.

BACKGROUND

EP 2 930 275 B1 discloses a drilling apparatus and a method for producing a foundation for a structure in the water. A guide apparatus is placed on the bottom surface of a body of water. A support tube is arranged in the guide apparatus. By means of a drilling rig, which is inserted into the support tube, a borehole is drilled into which the support tube is lowered. After removing the in-hole drilling rig, a foundation element can be inserted into the support tube. The support tube is then pulled, wherein an intermediate space between the bore wall and the inserted foundation element is filled.

EP 2 615 239 B1 discloses an apparatus and a method for creating an underwater foundation. In this case, a support tube is also inserted into the ground, in which an in-hole drilling rig is arranged. The in-hole drilling rig removes soil material, wherein the surrounding support tube can be pushed along axially.

Another known apparatus and method for producing a foundation for a structure in the water are disclosed in EP 3 333 324 A1.

SUMMARY

The invention is based on the object of specifying a drilling apparatus and a method with which a cased borehole can be created particularly efficiently under water.

According to the invention, the object is achieved on the one hand by an underwater drilling apparatus having the features of claim 1 and on the other hand by a method having the features of claim 12. Preferred embodiments of the invention are specified in the dependent claims.

The underwater drilling apparatus according to the invention for creating a cased borehole under water comprises a lowerable platform configured for setting down on a waterbody bottom, at least one support tube axially displaceable and rotatably mounted on the platform, at least one tubular drive arranged on the platform and is configured for rotationally driving the support tube in order to rotationally introduce the support tube into the waterbody bottom, at least one in-hole drilling rig arranged in the support tube, wherein the in-hole drilling rig comprises:

- a rig base body,
- at least one clamping device for bracing and securing the in-hole drilling rig in the support tube,
- a drill drive on the rig base body, and
- a drill head axially displaceable and rotatably mounted on the rig base body and rotationally drivable by means of the drill drive, wherein when rotationally driving the support tube, the in-hole drilling rig is arranged in the support tube and axially clamped thereto.

A first aspect of the invention is to provide, at an underwater drilling apparatus, at least one tubular drive on the lowerable platform for rotationally driving the support tube, wherein the tubular drive is configured to rotationally introduce the support tube into the waterbody bottom.

According to a further aspect, the underwater drilling apparatus having the tubular drive is configured such that an in-hole drilling rig arranged in the support tube is clamped to the support tube when rotationally driving the latter, so that it rotates with the rotating support tube. This allows efficient step-by-step drilling of the support tube and the drilling rig. Depending on the type of soil in-situ, either the support tube or the drill head of the drilling rig can advance. While the drill head is rotationally driven, the drilling rig can be clamped to the stationary support tube. After a drilling step with the drill head of the drilling rig, the support tube can be rotationally introduced into the ground by a further advance step, wherein the in-hole drilling rig remains connected to the support tube in a rotationally fixed manner. When the support tube is rotationally driven, the drill head can remain stationary relative to the rig base body. Alternatively, the drill head can be rotationally driven at the same time, in the same or the opposite direction of rotation as the support tube.

In principle, the tubular drive on the lowerable platform may be configured to rotationally drive the support tube in any suitable manner. A preferred embodiment of the invention is that, in order to form the tubular drive on the platform, a collet device for clamping the support tube is arranged on its outer side so as to be rotatable or pivotable and axially movable, wherein a torque of the tubular drive can be transmitted to the support tube.

The tubular drive may be configured similar to a casing apparatus, wherein a releasable gripping of the support tube on the outer side can be effected by means of a collet. Preferably by means of hydraulic cylinders, the collet can be rotated about the tube longitudinal axis.

According to one variant of the invention, it is particularly advantageous that the tubular drive is configured for transmitting a continuous rotary motion to the support tube. Thereby, a continuous rotary drive can be provided. Furthermore, two or more collets may be provided, each having a rotary cylinder, wherein each arrangement with a collet performs a specific twist through a predetermined angular range. By a coordinated, successive twist by at least two such arrangements, a continuous or quasi-continuous rotation of the support tube can be effected.

Alternatively or additionally, according to a further development of the invention, it is provided that the tubular drive is configured for transmitting an oscillating rotary motion to the support tube. This oscillating or stepwise rotary motion may be effected in particular by an arrangement with a single collet device.

The in-hole drilling rig may be suspended in the support tube via a suspension cable, so that an application of a feed force can be effected solely by the weight force of the in-hole drilling rig. According to an advantageous embodiment of the invention, it is preferred that the in-hole drilling rig comprises an axial feed device with which the drill head is axially displaceable relative to the rig base body. The rig base body may comprise a frame structure securable in a rotationally fixed manner in the inner wall of the support tube, preferably by means of radially extendable hydraulic clamping cylinders. The feed device may comprise one or more hydraulic actuating cylinders aligned in the axial direction. Thereby, a rotationally driven drill head can be axially displaced relative to the rig base body. The drill drive, which may preferably comprise one or more hydraulic rotary motors, may be provided axially fixed on the base body, wherein a drill drive shaft can be axially telescoped by means of a corresponding spline toothing or another suitable formation. Thereby, torque transmission from the drill drive to the axially displaceable drill head can be effected.

In principle, the feed device may be configured in any suitable way. According to one variant of the invention, it is particularly advantageous that the feed device comprises at least one hydraulic feed cylinder. The feed cylinder may be a single-acting or double-acting actuating cylinder.

According to a further development of the invention, it is advantageous for efficient lowering of a cased borehole that two or more support tubes are rotationally and axially displaceably mounted on the platform. The platform may be configured as a template for a predetermined arrangement of support tubes in a waterbody bottom. In principle, a dedicated in-hole drilling rig may be arranged in each support tube. Alternatively, a single in-hole drilling rig may be provided, which is initially inserted in a first support tube to create a first borehole. After the first borehole has been created, the in-hole drilling rig may be released and retracted from the first support tube and inserted into a second support tube to create a second cased borehole. This can be repeated according to the number of support tubes present. Tubular drives are preferably arranged on the platform according to the number of support tubes provided.

During drilling operation, the in-hole drilling rig is connected to a supply unit, in particular a supply ship, at the waterbody surface via one or more lines, in particular a so-called umbilical. Via the one or more lines, energy, in particular electrical energy and/or hydraulic energy, is transmitted. When rotating the support tube together with the in-hole drilling rig fastened therein, it must be ensured that no twisting of the one or more lines occurs. For this purpose, the at least one line may be connected to the in-hole drilling rig, at an upper region of the latter, by means of a corresponding rotary coupling. In particular, a so-called rotary union may be provided for the passage of hydraulic fluid.

A simplified embodiment of the invention for avoiding twisting of the at least one line is that at least one upper clamping device is arranged on the rig base body and at least one lower clamping device is arranged on the drill head. Thereby, a targeted alternating bracing of the drill head and/or the rig base body can take place.

In particular, according to one variant of the invention, it is provided that, when the support tube is rotationally driven, the at least one lower clamping device on the drill head is radially extended and the drill head is clamped to the support tube, and the at least one upper clamping device on the rig base body is radially retracted and released from the support tube. In this state, the rotary drive may be uncoupled from the drill head or a free run can be selected. In this arrangement, when the support tube is rotationally driven, the drill head can rotate with, while the rig base body does not follow the rotary motion due to the selected free run of the drill drive. In this way, the rig base body with the lines connected thereto can stand still, while the drill head is rotated with the rotationally driven support tube. With this arrangement, twisting of the at least one connected line can thus be avoided without having to provide a special line coupling or a rotary union on the line. Alternatively, the rig base body may be clamped and fixed to the support tube so that the in-hole drilling rig is turned in with the support tube.

If the support tube is not turned in circumferentially, but in an oscillating manner, a special line coupling or rotary union can also be omitted.

A further preferred variant of the invention is that the platform, at the waterbody bottom, comprises a supply device connected to an overwater supply unit via at least one main supply line, and that the at least one tubular drive and the at least one in-hole drilling rig are connected to the supply device of the platform for energy supply, in particular via supply lines. The supply device at the platform may preferably store energy to a certain extent, for example electrical energy by means of provided rechargeable batteries or hydraulic energy by means of corresponding pressure accumulators. The platform may thus be operated self-sufficiently for a certain period of time, which may be necessary, for example, in the event of rough weather conditions and an associated disconnection of the main supply line. The supply device at the platform is in connection to an overwater supply unit via the preferably releasable main supply line. The overwater supply unit may in particular be a vessel.

The invention further comprises a method for creating a cased borehole under water comprising an underwater drilling apparatus according to the invention, wherein at least one support tube is arranged on a platform of the underwater drilling apparatus, at least one in-hole drilling rig, in which at least one support tube is arranged, the platform is lowered onto a waterbody bottom, the at least one support tube is rotationally driven via a tubular drive at the platform and is drilled into the waterbody bottom, prior and/or subsequent to the drilling of the support tube, the drill head of the in-hole drilling rig arranged in the support tube is rotationally driven and is drilled into the waterbody bottom in order to create the borehole, while the support tube is held on the platform in a rotationally fixed manner, and when the support tube is rotationally driven, the in-hole drilling rig remains in the support tube and is axially clamped thereto.

The method can be carried out, in particular with the underwater drilling apparatus according to the invention described above. The advantages described in this context can be achieved. The method according to the invention comprises the method steps specified in claim 1, but is not limited to a specific sequence of the method steps. Individual method steps can also be carried out before or after other method steps.

BRIEF DESCRIPTION OF THE DRAWINGS

The invention is further described below with reference to preferred exemplary embodiments, which are shown schematically in the accompanying drawings. The drawings show.

DETAILED DESCRIPTION

Figure 1:
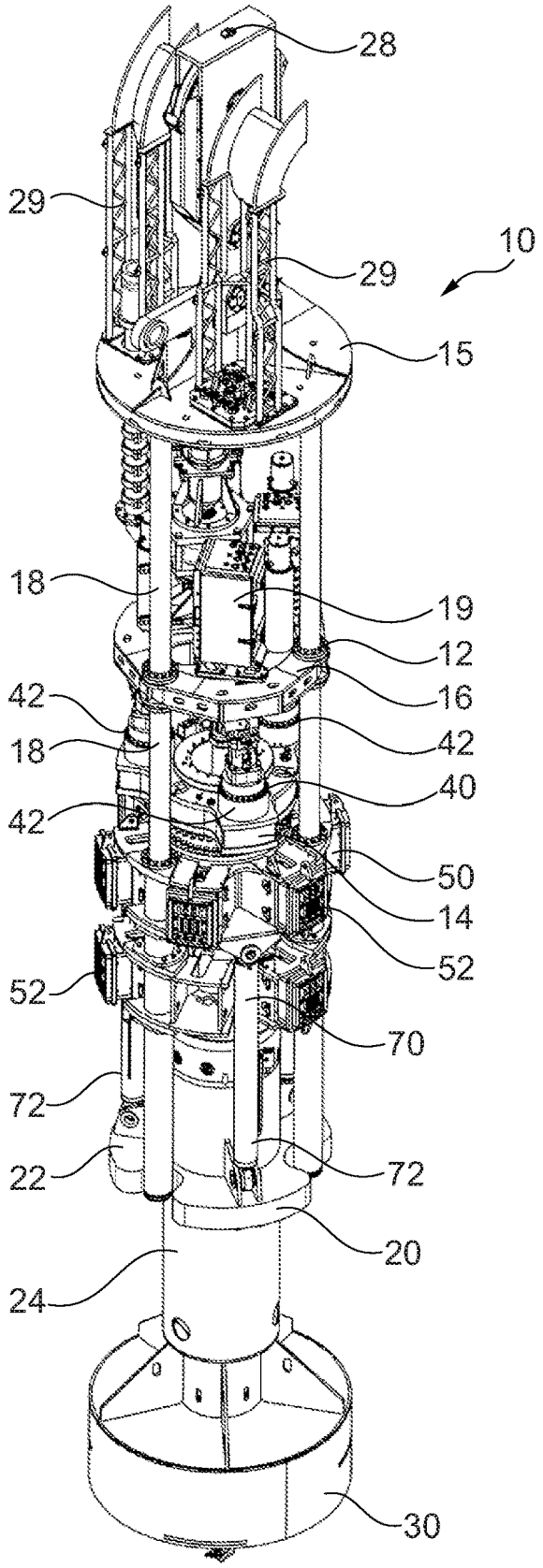
FIG. 1 a perspective view of an in-hole drilling rig according to the invention with the drill head retracted.

In FIGS. 1 to 4, an exemplary embodiment of an in-hole drilling rig 10 for forming an underwater drilling apparatus 100 according to the invention is shown. The in-hole drilling rig 10 comprises a framework-like rig base body 12 comprising a first annular frame portion 14. On the upper side of this plate-like first frame portion 14, a drill drive 40 is arranged, which, in the illustrated exemplary embodiment, is formed by three hydraulic rotary drives 42 arranged to be uniformly distributed around a longitudinal or drilling axis of the in-hole drilling rig 10.

The clamping device 50 is attached to the lower side of the first frame portion 14, which is configured for radially bracing and fixing the in-hole drilling rig 10 relative to a wall of a support tube and/or a drill hole. In the illustrated exemplary embodiment, the annular clamping device 50 comprises six non-visible and radially directed clamping cylinders, on the outer side of which plunger-like clamping plates 52 are attached. The clamping cylinders having the clamping plates 52 are uniformly distributed around the longitudinal or drilling axis of the in-hole drilling rig 10.

An upper frame portion 15 is arranged at the upper end of the frame 12. Between the upper frame portion 15 and the first frame portion 14 therebelow, a plate-shaped ring-like intermediate portion 16 is arranged, which is connected via vertically directed connecting struts 18 on the one hand to the first frame portion 14 and on the other hand upwardly to the upper frame portion 15.

A connecting device 28 for a cable suspension of the in-hole drilling rig 10 is arranged centrally on an upper side of the upper frame portion 15, and two line feeds 29 are arranged laterally thereon. The line feeds 29 serve on the one hand for feeding a hydraulic hose line and on the other hand for feeding and holding a drilling slurry discharge line.

Further feeds for compressed air for an air lifting method as well as of electrical power and data lines as well as further supply lines may be provided.

Control components 19 may be arranged on the plate-like intermediate portion 16. Overall, the upper region of the rig base body 12 may have a modular structure with the first frame portion 14, the upper frame portion 15 and the intermediate portion 16, so that the in-hole drilling rig 10 may be adapted in a simple manner to different drill hole sizes and application areas.

Figure 3:
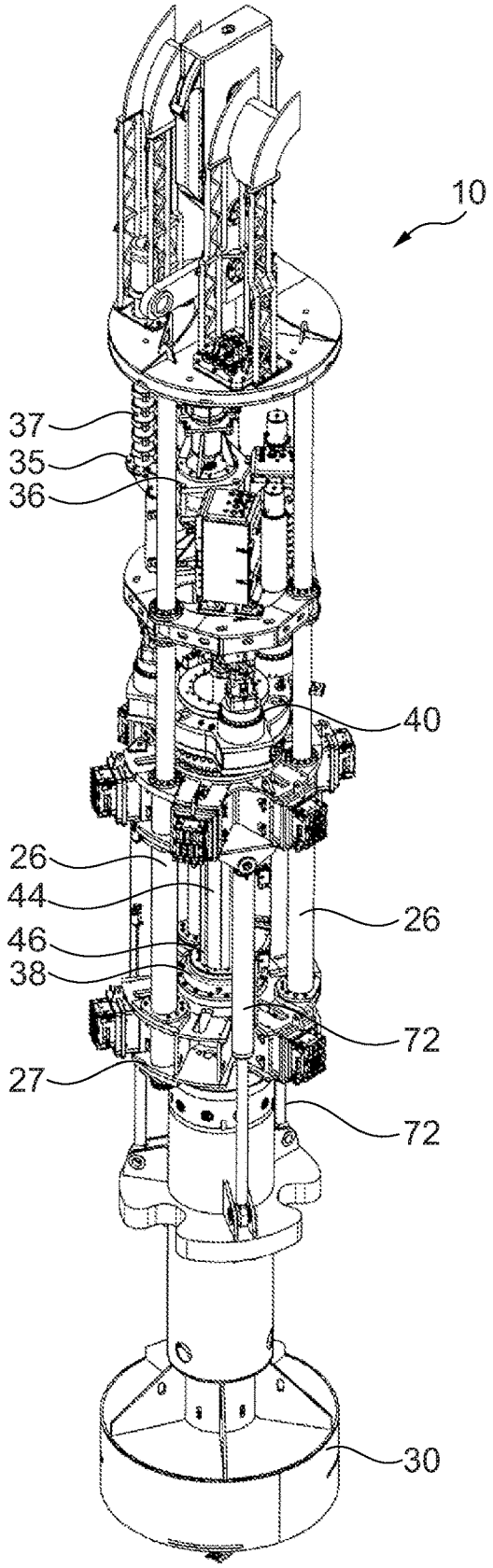
FIG. 3 a perspective view of the in-hole drilling rig of FIGS. 1 and 2 with the drill head extended.
Figure 4:
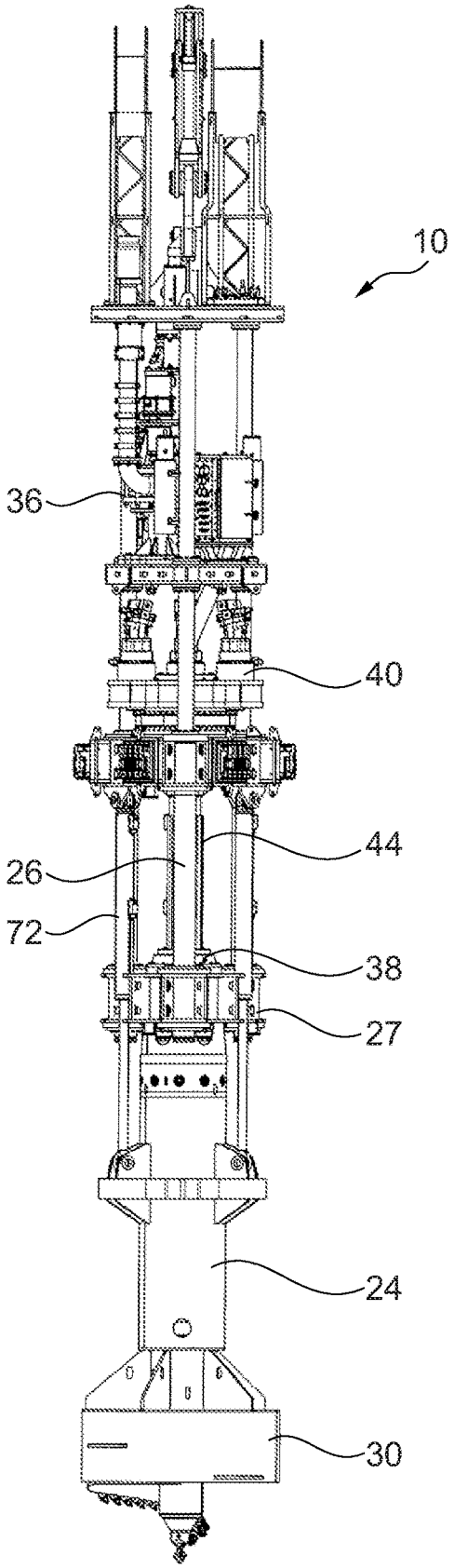
FIG. 4 a side view of the in-hole drilling rig in the state of FIG. 3.

Below the clamping device 50 on the first frame portion 14, the feed device 70 with hydraulic feed cylinders 72 is arranged. The feed cylinders 72 are fastened to the first frame portion 14 with their cylinder housings. By means of the extendable cylinder piston, the feed cylinders 72 on the other hand are hinged to a second annular, plate-like second frame portion 20. The annular second frame portion 20 is fastened to an outer surface of a tubular bearing sleeve 24, in which a tubular drill string 38, only partially visible in FIGS. 3 and 4, is mounted to be rotatable but axially fixed. A drill head 30 is fastened to the lower end of the drill string 38. The drill head 30 comprises a central pilot tip 32 and radially directed removal elements 34, which are configured for removing soil material. The second frame portion 20 is mounted to be axially adjustable relative to the first frame portion 14.

At an upper end region of the tubular drill string 38, a drive shaft 44 of the drill drive 40 extends into the tubular drill string 38. The drive shaft 44 comprises outer, axially extending drive strips 46, which cooperate with corresponding inner drive strips on the inner side of the tubular drill string 38 for torque transmission. Via the drive shaft 44, the drill string 38 is rotationally driven with the drill head 30 so that the latter can remove soil material.

Figure 2:
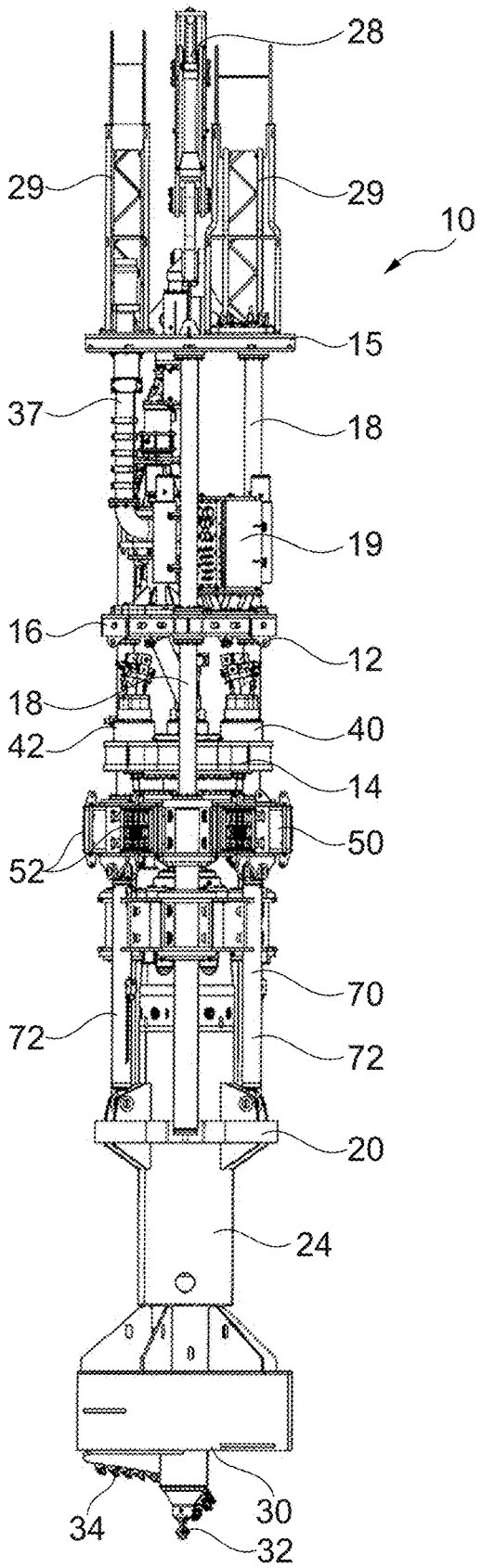
FIG. 2 a side view of the in-hole drilling rig in the state of FIG. 1.

In FIGS. 1 and 2, the in-hole drilling rig 10 is shown in a state in which the drill head 30 is axially retracted. In this state, the in-hole drilling rig 10 can be fixed in the drill hole via the clamping device 50 by radial extension of the clamping plates 52 against a support tube. Subsequently, with the drill head 30 rotating, the feed device 70 can be actuated, wherein the feed cylinders 72 extend downward. Thereby, the second frame portion 20 having the bearing sleeve 24 and the drill head 30 mounted thereon can be moved downward to cause a corresponding advance during drilling. Alternatively, the drill head 30 and/or in-hole drilling rig may be braced or fixed in place when the support tube 8 is turned in.

When a maximum extension length of the feed cylinders 72 of the feed device 70 is reached, which is shown in FIGS. 3 and 4, the bracing by the clamping device 50 can be released by retracting the clamping plates 52. The upper region of the rig base body 12 may be guided along downward by retracting the feed cylinders 72 and slackening a suspension cable fastened to the connecting device 28 until the axially retracted state according to FIGS. 1 and 2 is reached again. Now, after the rig base body 12 has been clamped again by means of the clamping device 50, a further drilling step may be carried out. Alternatively, the clamping plates 52 may be radially extended and remain fixed to the support tube 8. The support tube 8 can thus be turned into the ground and guided along. The feed cylinders 72 may be retracted during this process.

Soil material produced during drilling may be discharged through the frame 12 via the hollow drill string 38, the hollow drive shaft 44 by means of a suction pump 36 as a conveying device 35 and transported away to outside of the drill hole via a partially shown conveying line 37. The second frame portion 20 having the bearing sleeve 24 may comprise a third frame portion 27, which may be mounted to be linearly displaceable via linear guides 26 which are fixedly attached to the first frame portion 14 and directed downwards. The guides 26 may absorb torsional forces in the circumferential direction, so that the feed cylinders 72 are relieved of transverse forces.

Figure 5:
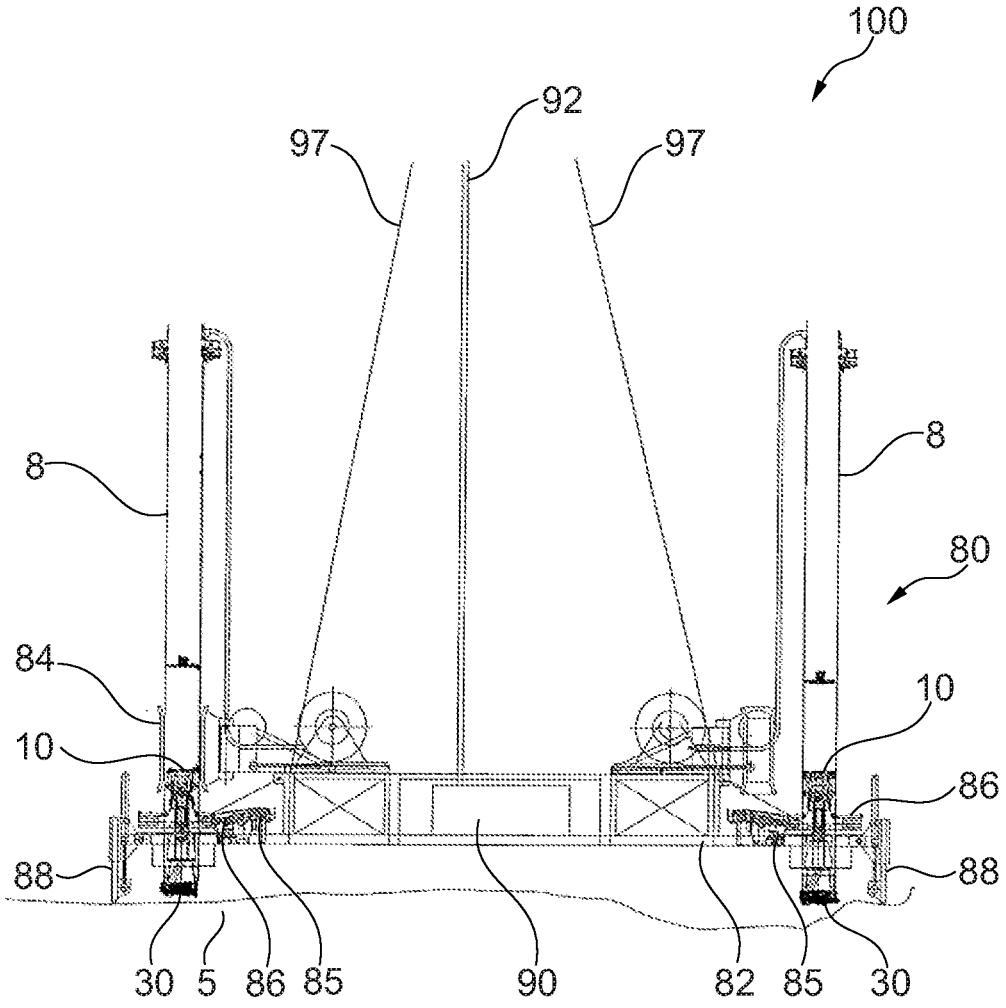
FIG. 5 a side view of a platform for forming the underwater drilling apparatus according to the invention.

As shown in FIG. 5, an underwater drilling apparatus 100 according to the invention comprises a lowerable platform 80 having a working stage 82, which is suspended from a cable arrangement 97 shown only in part, and which may be lowered and set down onto a waterbody bottom 5 via this cable arrangement 97 with adjustable feet 88.

As shown in FIG. 5, a plurality of support tubes 8 with in-hole drilling rigs 10 inserted therein may be arranged on the working stage 82, of which two in-hole drilling rigs 10 are visible in the side view in FIG. 5. Four in-hole drilling rigs 10 may be arranged at the corners of the working stage 82, which is configured as a geometric rectangle, or three in-hole drilling rigs 10 may be arranged at the corners of the working stage, which is configured as an equilateral triangle.

The in-hole drilling rigs 10 are formed substantially equal so as this is previously described.

The in-hole drilling rig 10 serves for introducing a support tube 8 into the waterbody bottom 5. A sleeve-like linear guide 84 and a tubular drive 85 for each in-hole drilling rig 10 or each drill hole are arranged on the working stage 82. The linear guide 84 guides the support tube 8 vertically displaceable on the working stage 2. The drilling unit 100 further comprises, for forming the tubular drive 85, a collet device 86 for securing in a rotationally fixed manner, rotating and/or axially displacing the support tube 8 on the working stage 82. This collet device 86 is arranged below the linear guide 84 on the working stage 82. The collet device 86 may be configured, for example, as a hydraulic clamping device and also comprises means for axially securing the support tube 8, i. e. means for securing it against displacement in the vertical direction. The collet device 86 may thus ensure that, for example, the support tube 8 maintains its rotational position but also its axial position relative to the working stage 82 during lowering of the working stage 82, but also during the drilling operation.

In order to produce a borehole into which the support tube 8 is introduced, the in-hole drilling rig 10 is inserted thereinto. At the lower end of the in-hole drilling rig 10, a drill head 30 configured as a full-face drill head or another suitable drill head which is equipped with roller bits, may be provided. The drill head 30 may protrude at the lower end of the support tube 8, so that the drill head 30 can clear soil material below the support tube 8. The support tube 8 may be pushed axially following the in-hole drilling rig 10 in a rotating manner via the collet device 86. When the support tube 8 is displaced, the in-hole drilling rig 10 may be braced in the support tube 8 and thus guided along with it. An energy supply may be provided via a main supply line 92 to a central supply device 90 on the working stage 82.

The invention claimed is:

1. An underwater drilling apparatus for creating a cased borehole under water, comprising a lowerable platform configured for setting down on a waterbody bottom, at least one support tube axially displaceable and rotatably mounted on the platform, at least one tubular drive arranged on the platform and configured for rotationally driving the support tube, in order to rotationally introduce the support tube into the waterbody bottom, at least one in-hole drilling rig arranged in the support tube, wherein the in-hole drilling rig comprises:

a rig base body, at least one clamping device for bracing and securing the in-hole drilling rig in the support tube, a drill drive on the rig base body, and a drill head which is axially displaceable and rotatably mounted on the rig base body and can be rotationally driven by means of the drill drive, wherein when rotationally driving the support tube, the in-hole drilling rig is arranged in the support tube and is axially clamped thereto.

2. The underwater drilling apparatus according to claim 1, wherein, in order to form the tubular drive at the platform, a collet device for clamping the support tube on its outer side is arranged to be rotatably or pivotably and axially movable, wherein a torque of the tubular drive can be transmitted to the support tube.

3. The underwater drilling apparatus according to claim 1, wherein the tubular drive is configured for transmitting a continuous rotary motion to the support tube.

4. The underwater drilling apparatus according to claim 1, wherein the tubular drive is configured for transmitting an oscillating rotary motion to the support tube.

5. The underwater drilling apparatus according to claim 1, wherein the in-hole drilling rig comprises an axial feed device with which the drill head is axially displaceable relative to the rig base body.

6. The underwater drilling apparatus according to claim 5, wherein the feed device comprises at least one hydraulic feed cylinder.

7. The underwater drilling apparatus according to claim 1, wherein at least one supply line is connected to the in-hole drilling rig at an upper portion of the rig base body.

8. The underwater drilling apparatus according to claim 1, wherein two or more support tubes are rotatably and axially displaceably mounted on the platform.

9. The underwater drilling apparatus according to claim 1, wherein at least one upper clamping device is arranged on the rig base body and at least one lower clamping device is arranged on the drill head.

10. The underwater drilling apparatus according to claim 9, wherein when the support tube is rotationally driven, the at least one lower clamping device on the drill head is radially extended and the drill head is clamped to the support tube and the at least one lower clamping device on the rig base body is radially retracted and is released from the support tube.

11. The underwater drilling apparatus according to claim 1, wherein the platform at the waterbody bottom comprises a supply device connected to an overwater supply unit via at least one main supply line, and the at least one tubular drive and the at least one in-hole drilling rig are connected to the supply device of the platform for energy supply, in particular via supply lines.

12. A method for creating a cased borehole under water with an underwater drilling apparatus according to claim 1, wherein at least one support tube is arranged on a platform of the underwater drilling apparatus, at least one in-hole drilling rig is arranged in the at least one support tube, the platform is lowered onto a waterbody bottom, the at least one support tube is rotationally driven via a tubular drive at the platform and is drilled into the waterbody bottom, prior and/or subsequent to the drilling of the support tube, the drill head of the in-hole drilling rig arranged in the support tube is rotationally driven and is drilled into the waterbody bottom to create the borehole, while the support tube is held on the platform in a rotationally fixed manner, and when the support tube is rotationally driven, the in-hole drilling rig remains in the support tube and is axially clamped thereto.

* * * * *